United States Patent [19]

Komorowski et al.

[11] Patent Number: 4,644,864

[45] Date of Patent: Feb. 24, 1987

[54] VARIABLE TIMING AND POWER STORAGE ARRANGEMENTS

[75] Inventors: Robert Komorowski, Hampshire; Harpal Punia, Southampton, both of England

[73] Assignee: Plessey Overseas Limited, Ilford, England

[21] Appl. No.: 692,424

[22] Filed: Jan. 18, 1985

[30] Foreign Application Priority Data

Jan. 25, 1984 [GB] United Kingdom ..... 8401893

[51] Int. Cl.[4] ..... F42C 11/06

[52] U.S. Cl. ..... 102/215; 102/206; 102/505

[58] Field of Search ..... 102/206, 209, 215, 218, 102/505; 89/6.5

[56] References Cited

U.S. PATENT DOCUMENTS

| | | | |
|---|---|---|---|
| 3,500,746 | 3/1970 | Ambrosini | 102/215 |
| 4,137,850 | 2/1979 | Donner | 102/215 |
| 4,142,442 | 3/1979 | Tuten | 102/215 |
| 4,160,416 | 7/1979 | Baracz | 102/215 |
| 4,240,350 | 12/1980 | Munzel et al. | 102/206 |
| 4,487,125 | 12/1984 | Zuk | 102/206 |

FOREIGN PATENT DOCUMENTS

| | | | |
|---|---|---|---|
| 1535795 | 12/1978 | United Kingdom . | |
| 2118746 | 11/1983 | United Kingdom | 102/215 |

*Primary Examiner*—Charles T. Jordan

*Attorney, Agent, or Firm*—Fleit, Jacobson, Cohn & Price

[57] ABSTRACT

A variable timing power storage arrangement for presetting a time interval between launch of a projectile and the initiation of a particular function or functions of said projectile and for storing power required inter alia for the initiation of said function or functions at the expiration of said interval, the arrangement comprising inductive coupling means for establishing before launch of the projectile an electrical coupling path between the projectile and control means associated with projectile launching means, signal generating means associated with the control means for generating a train of tone-burst modulated pulses for transmission over said inductive coupling means to the projectile, rectifying means in said projectile for rectifying the pulses of said train the first of which is utilized for charging up power storage capacitor means in the projectile to provide a d.c. power supply which serves inter alia for subsequently initiating a function or functions of the projectile and the subsequent pulses of said train being utilized for the setting of counter means in the projectile in accordance with the requisite duration of the time interval between launch of the projectile and initiation of the aforesaid particular function or functions and means in the projectile responsive to the firing or launch of said projectile to cause the counter means to commence a counting-out operation at a predetermined rate at the termination of which the power storage capacitor means is discharged for the initiation of said function or functions of the projectile.

5 Claims, 2 Drawing Figures

VARIABLE TIMING AND POWER STORAGE ARRANGEMENTS

BACKGROUND

This invention relates to variable timing and power storage circuit arrangements for use in projectiles or rockets to pre-set the time interval between launch of the projectile and the execution of a particular function or functions by the projectile and for providing power storage in such projectiles. The present invention is especially, but not exclusively, suitable for use in radar decoy chaff-dispensing projectiles for initiating a chaff-dispensing operation at a pre-set time interval after launch of the projectile when the projectile is located at the requisite chaff-dispensing location. For the purpose of pre-setting the time interval between launch of the projectile and for deriving electrical power to initiate the chaff-dispensing function at the expiration of said interval electric signals may be transmitted to the projectile or rocket through inductive coupling means which serve to electrically couple the projectile to control means when the projectile is located within its launching barrel.

SUMMARY

According to the present invention there is provided a variable timing power storage arrangement for pre-setting a time interval between launch of a projectile and the initiation of a particular function or functions of said projectile and for storing power required inter alia for the initiation of said function or functions at the expiration of said interval, the arrangement comprising inductive coupling means for establishing before launch of the projectile an electrical coupling path between the projectile and control means associated with projectile launching means, signal generating means associated with the control means for generating a train of tone-burst modulated pulses for transmission over said inductive coupling means to the projectile, rectifying means in said projectile for rectifying the pulses of said train the first of which is utilised for charging up power storage capacitor means in the projectile to provide a d.c. power supply which serves inter alia for subsequently initiating a function or functions of the projectile and the subsequent pulses of said train being utilised for the setting of counter means in the projectile in accordance with the requisite duration of the time interval between launch of the projectile and initiation of the aforesaid particular function or functions and means in the projectile responsive to the firing or launch of said projectile to cause the counter means to commence a counting-out operation at a predetermined rate at the termination of which the power storage capacitor means is discharged for the initiation of said function or functions of the projectile.

BRIEF DESCRIPTION OF THE DRAWINGS

By way of example one embodiment of the invention will now be described with reference to the accompanying single-figure drawing, FIGS. 1(1) and 1(2), which shows a circuit arrangement for use in a chaff-dispensing projectile to time the interval between launch of the projectile and the dispensing of chaff for radar decoy purposes and to store electrical power for the operation of the circuit arrangement before and following launch including the initiation of a chaff-dispensing operation.

DETAILED DESCRIPTION

Figure 1:
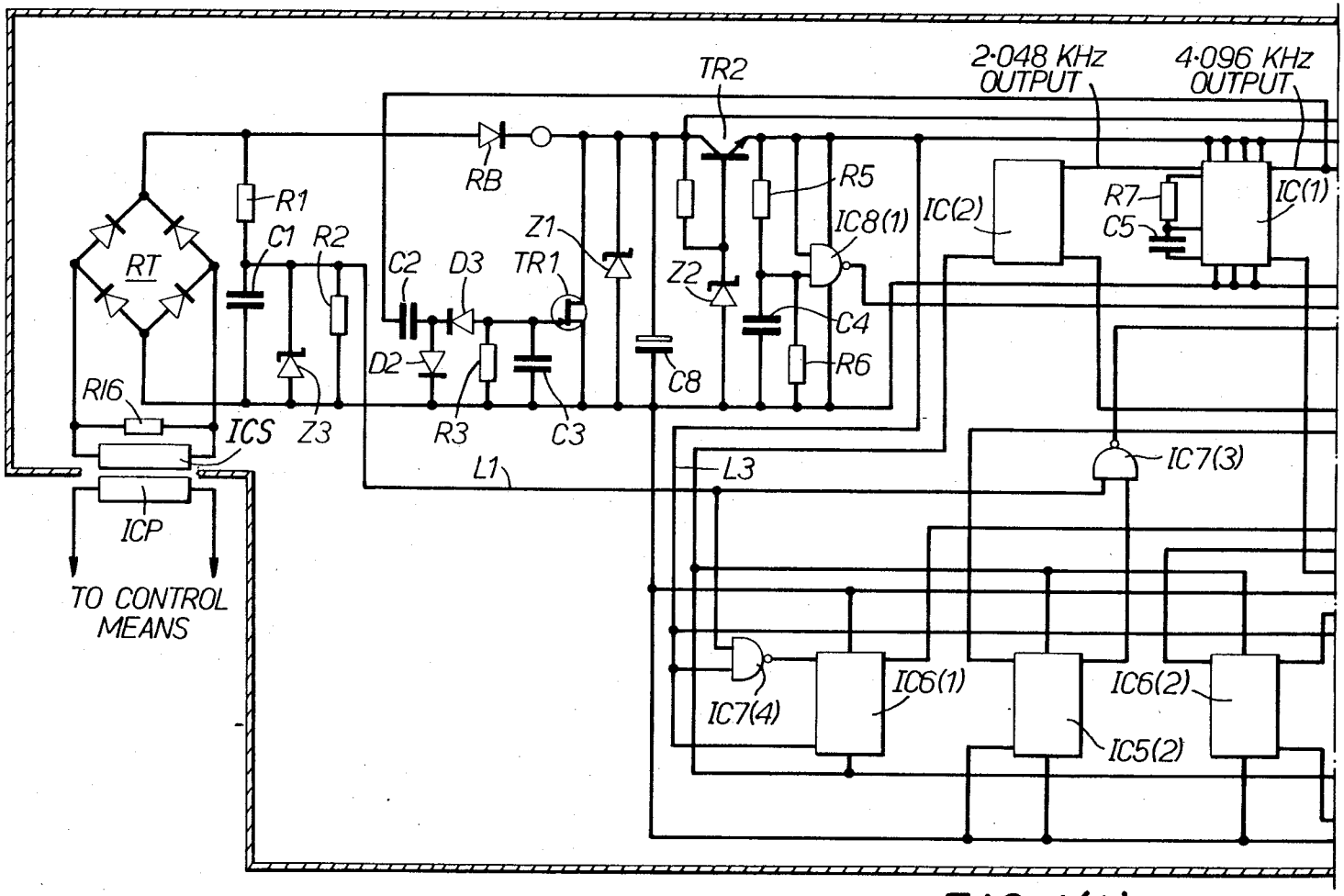
Figure 1:
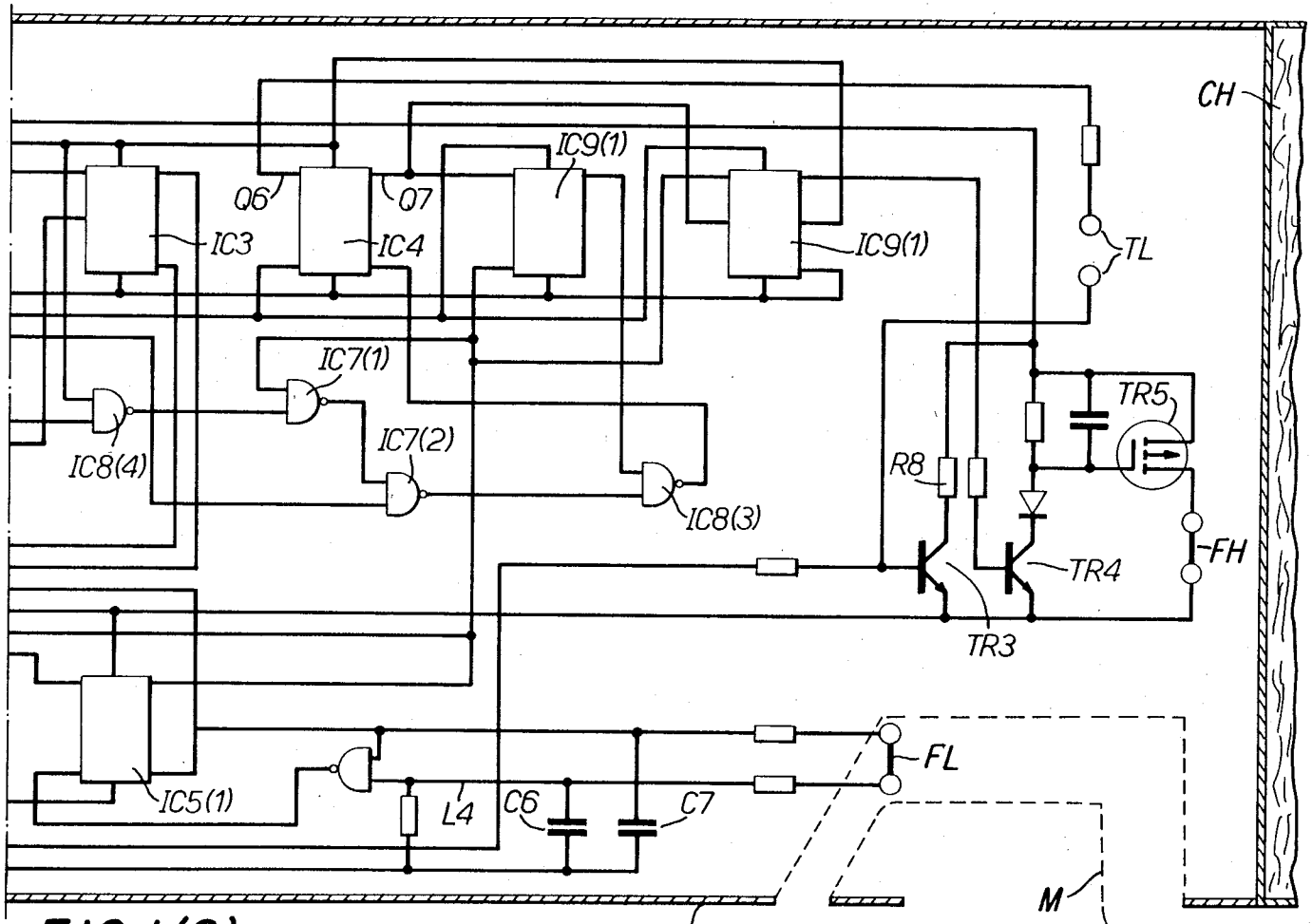

Referring to the drawing the circuit arrangement illustrated will be housed within the casing of a chaff-dispensing projectile PR provided with a rocket propulsion motor and chaff CH. The projectile is adapted to be launched from a launching barrel of a projectile launching structure. For the purpose of affording electrical control between the launching structure and a rocket firing circuit arrangement (not shown) and the timing and power storage circuit arrangement depicted in the accompanying drawing an inductive coupling arrangement is provided a primary section ICP of which forms part of the base end of the launch barrel and a secondary section ICS is embodied in the rear end of a projectile adapted to be positioned in the launch barrel prior to launch.

Before launching the chaff-dispensing projectile PR from the launcher the time interval between the launch and the dispensing of chaff by the projectile needs to be pre-set in accordance with requirements and, moreover, electrical power to operate the timing circuit arrangement and to initiate the chaff-dispensing operation after the launch needs to be stored in the arrangement shown in the drawing. For these purposes a train of rectangular tone-burst modulated pulses (e.g. tone frequency 11 kHz) are produced by pulse generating means (not shown) associated with the projectile launcher. These pulses are transmitted through the inductive coupling ICP and ICS to the projectile circuitry where they are rectified by means of a full-wave rectifier RT, a noise-filtering resistor R16 being connected across the rectifier input.

The first rectified pulse from the rectifier RT is utilised to charge up a very low leakage power storage capacitor C8 which will constitute the dc power supply for the projectile. A typical duration for this first pulse would be 15 ms. As the capacitor C8 charges up through a blocking rectifier RB a zener diode Z1 limits the voltage across capacitor C8 and a transistor TR2 which forms part of a voltage regulating arrangement including another zener diode Z2 is rendered conducting and applies a low dc voltage (e.g. 5 volts) to a number of integrated logic devices to be described later including an oscillator comprising a monostable/astable multivibrator IC1 having resistor and capacitor tuning components R7 and C5 which commences operation to provide a signal output (e.g. 4.096 KHz). It may here be mentioned that the output from the oscillator is fed through a capacitor C2 to a diode pump circuit comprising diodes D2 and D3 associated with resistor R3 and capacitor C3 and a transistor TR1. The function of this circuit is to ensure that when the circuit arrangement of FIG. 1 is inoperative the transistor TR1 is turned off and thereby provides therethrough a relatively low resistance path for the gradual discharge of any charge on capacitor C8. However, as soon as the oscillator IC1 starts to operate the transistor TR1 is turned on and thereby presents a very high resistance path across the storage capacitor C8.

It may here also be mentioned that a potentiometer R1 and R2 and zener diode Z3 with a filter capacitor C1 connected across it serves to provide a low dc voltage (e.g. 5 volts) on line L1 for the conditioning of NAND gates IC7(3) and IC7(4). Reverting to voltage regulating arrangement including the transistor TR2, as this transistor TR2 conducts, resistors R5 and R6 and capacitor C4 generate a re-set pulse for re-setting some of the logic devices (i.e. binary counters IC2 and IC4 and flip-flop devices IC9(1), IC6(1) and IC5(1)) referred to above, the edge of the re-set pulse being sharpened by feeding the pulse into an integrated circuit NAND gate device IC8(1). As previously mentioned, the capacitor C8 charge pulse is followed by a number of timing pulses which determine the time interval between launch of the projectile and the initiation of the chaff-dispensing operation. For the purpose of imposing a maximum time limit for the reception of these timing pulses received by the projectile it is arranged that the trailing (negative-going) edge of the charge pulse is detected over line L3 by flip-flop device IC6(1) which accordingly provides an output to re-set a binary counter IC3 which then commences counting under control of the output from oscillator IC1. After a pre-determined period (e.g. 125 m.secs.) an output from the counter IC3 is fed to a "time-expired" latch flip-flop device IC6(2) which operates to prevent any further timing pulses being received by the projectile.

The timing pulses received by the projectile cause binary counter IC4 to be stepped to a timing count position corresponding to the number of timing pulses received. When a timing operation begins for timing the interval between launch of the projectile PR and the instant when chaff-dispensing is to begin the counter IC4 will be stepped on from its pre-set timing count position to a final count position (e.g. count position 64) at a pre-determined rate as will be described later. The pre-set time interval is therefore dependent upon the difference between the number of timing pulses received and the total count capability of the counter IC4.

It may here be mentioned that when the projectile PR is launched in response to a signal applied to the projectile rocket motor firing arrangement (not shown) through the previously-mentioned inductive coupling arrangement a fusible link FL will be melted or fused by the heat from the rocket motor exhausted through rocket motor exhaust means M. If, however, this link FL is not fused within a predetermined time period (e.g. 1 second) from the trailing edge of the charge pulse then a "discharge latch" flip-flop IC6(2) will produce an output turning on transistor TR3 which provides a discharge path for the capacitor C8 through resistor R8 and thereby deprives the projectile of its power supply for the timing function and the initiation of the chaff-dispensing operation.

Assuming however that the fusible link FL is broken, indicating proper firing of the rocket motor and launch of the projectile PR, an output from flip-flop device IC5(1) causes oscillator IC1 to produce an output which in turn causes counter IC4 to commence its counting operation towards its final count position at a rate controlled in dependence upon the oscillator IC1 output. In this connection, an output from the oscillator IC1 of approximately 2 kHz is fed to a binary counter IC2 which serves as a divide-by-four counter. It is the consequential output of approximately 0.5 kHz from the counter IC2 which through the gates IC7 (1)(2) and IC8 (4)(3) steps the counter IC4 towards its final count position at which position a flip-flop device IC9(1) which receives an output from the counter IC4 turns on transistor TR4 which then turns on hexfet TR5. As hexfet TR5 conducts the capacitor C8 is discharged through a fuse head FH for the ignition thereof and the initiation of the chaff-dispensing operation.

A testing facility is provided for in the arrangement shown in which the circuit can be tested without blowing the fuse head FH. In order to test the arrangement test link terminals TL are short-circuited. The power capacitor charging and timing pulses are then fed into the arrangement as previously described. Thereafter, a negative transition occurs on line L4 when the fusible link FL is broken which causes the counter IC4 to start stepping towards its final count position under the control of the output from IC2 as previously described. When the final count position of IC4 is reached an output from the terminal Q6 of IC4 precedes an output from the terminal Q7 but because the test link terminals TL are bridged the output from IC4 turns on transistor TR3 in order to discharge the capacitor C8. This indicates that the power storage and timing facility of the arrangement is functioning properly.

We claim:

1. A variable timing power storage arrangement for pre-setting a time interval between launch of a rocket motor propelled projectile and the initiation of a particular function or functions of said projectile and for storing power required inter alia for the initiation of said function or functions at the expiration of said interval, the arrangement comprising inductive coupling means for establishing before launch of the projectile an electrical coupling path between the projectile and control means associated with projectile launching means, signal generating means associated with the control means for generating a train of tone-burst modulated pulses for transmission over said inductive coupling means to the projectile, rectifying means in said projectile for rectifying the pulses of said train the first of which is utilised for charging up power storage capacitor means in the projectile to provide a d.c. power supply which serves inter alia for subsequently initiating a function or functions of the projectile and the subsequent pulses of said train being utilised for the setting of counter means in the projectile in accordance with the requisite duration of the time interval between launch of the projectile and initiation of the aforesaid particular function or functions and means in the projectile responsive to the firing or launch of said projectile to cause the counter means to commence a counting-out operation at a predetermined rate at the termination of which the power storage capacitor means is discharged for the initiation of said function or functions of the projectile in which the means responsive to the firing of the projectile comprises a fusible link arranged to be melted by exhaust heat from the projectile rocket motor.

2. A variable timing power storage arrangement as claimed in claim 1, in which failure of the fusible link to be melted within a predetermined time period following the first (i.e. charge) pulse of said train of pulses causes the power storage capacitor means to be discharged thereby depriving the projectile of its power supply for performing the timing and other function(s) of the projectile.

3. A variable timing power storage arrangement as claimed in claim 1, in which the projectile comprises a chaff-dispensing projectile and wherein one of the functions initiated at the expiration of said interval is the dispensing of radar decoy chaff at a predetermined time interval after launch of the projectile.

4. A variable timing power storage arrangement as claimed in claim 1, in which the counter means comprises a binary counter which is arranged to be stepped or pre-set at a timing count position corresponding to the number of timing pulses received and subsequently to be stepped on from its pre-set timing count position to a final count position at a predetermined rate controlled in accordance with the output frequency of an oscillator powered from the capacitor means.

5. A variable timing power storage arrangement as claimed in claim 4, in which the counter provides a final count position output which produces operation of various switching devices to bring about the discharge of the capacitor means through a fuse head for the ignition thereof and the initiation of a chaff-dispensing operation of the projectile.

* * * * *